United States Patent [19]

Katchka

[11] Patent Number: 4,749,131

[45] Date of Patent: Jun. 7, 1988

[54] BURNER CONSTRUCTION AND METHOD OF MAKING THE SAME

[75] Inventor: Jay R. Katchka, Cypress, Calif.

[73] Assignee: Robertshaw Controls Company, Richmond, Va.

[21] Appl. No.: 40,221

[22] Filed: Apr. 20, 1987

Related U.S. Application Data

[62] Division of Ser. No. 769,548, Aug. 23, 1985, Pat. No. 4,684,340.

[51] Int. Cl.[4] ..... B05B 1/18

[52] U.S. Cl. ..... 239/567; 29/510; 29/517; 239/600

[58] Field of Search ..... 239/567, 600; 29/510, 29/517

[56] References Cited

U.S. PATENT DOCUMENTS

| | | | |
|---|---|---|---|
| 406,146 | 7/1889 | Robinson | 29/510 |
| 459,701 | 9/1891 | Fahnestock | 431/175 |
| 968,505 | 8/1910 | Ruud | 156/212 |
| 1,028,666 | 6/1912 | Betts | 239/567 |
| 1,781,785 | 11/1930 | Kerr | 239/567 X |
| 2,487,512 | 11/1949 | Berger | 29/510 X |
| 3,287,802 | 11/1966 | Robinson et al. | 29/510 X |
| 3,337,940 | 8/1967 | Stihl et al. | 29/510 X |
| 3,417,456 | 12/1968 | Carlson | 29/510 X |
| 3,917,443 | 11/1975 | Adams | 431/354 |
| 3,998,582 | 12/1976 | Katchka et al. | 431/349 |

*Primary Examiner*—Samuel Scott
*Assistant Examiner*—Allen J. Flanigan
*Attorney, Agent, or Firm*—Candor, Candor & Tassone

[57] ABSTRACT

A burner construction and method of making the same are provided, the burner construction comprising a cup-shaped housing member provided with a closed end and an open end interconnected together by a side wall that has burner ports therethrough for issuing fuel from the interior of the housing member, and an adapter member secured to the housing member to close the open end thereof and having an inlet for directing fuel from a source thereof into the interior of the housing member, the adapter member having a section that is press-fittingly disposed within the open end of the housing member and having an annular groove adjacent the side wall thereof and the housing member having an annular portion of the side wall deformed into the annular groove to secure the housing member to the adapter member.

8 Claims, 2 Drawing Sheets

BURNER CONSTRUCTION AND METHOD OF MAKING THE SAME

CROSS REFERENCE TO RELATED APPLICATION

This application is a divisional patent application of its copending parent patent application, Ser. No. 769,548, filed Aug. 23, 1985, now U.S. Pat. No. 4,684,340.

BACKGROUND OF THE INVENTION

1. Field of the Invention

This invention relates to a new burner construction and to a new method of making such a burner construction.

2. Prior Art Statement

It is known to provide a burner construction comprising a cup-shaped housing member provided with a closed end and an open end interconnected together by side wall means that has burner port means therethrough for issuing fuel from the interior of the housing means, and an adapter member secured to the housing member to close the open end thereof and having inlet means for directing fuel from a source thereof into the interior of the housing member. For example, see the U.S. Pat. No. 459,701 to Fahnestock; the U.S. Pat. No. 968,605 to Ruud; and the U.S. Pat. No. 3,917,443 to Adams.

It is also known to provide a burner construction having a flame sensing member, such as a thermocouple, carried by the burner construction. For example, see the U.S. Pat. No. 3,998,582 to Katchka et al; the U.S. Pat. No. 2,943,132 to Jackson; the U.S. Pat No. 3,265,539 to Baatrup; and the U.S. Pat. No. 2,649,490 to Greenamyer.

SUMMARY OF THE INVENTION

It is one feature of this invention to provide a new burner construction.

In particular, it was found according to the teachings of this invention that the cup-shaped housing member can have its open end secured to an adapter member in a relatively simple and unique manner by merely press-fitting a section of the adapter member into the open end of the housing member and then deforming an annular portion of the side wall means of the cup-shaped housing member into an annular groove of the section of the adapter member.

For example, one embodiment of this invention provides a burner construction comprising a cup-shaped housing member provided with a closed end and an open end interconnected together by side wall means that has burner port means therethrough for issuing fuel from the interior of the housing member, and an adapter member secured to the housing member to close the open end thereof and having inlet means for directing fuel from a source thereof into the interior of the housing member, the adapter member having a section that is press-fittingly disposed within the open end of the housing member and has an annular groove adjacent the side wall means thereof and the housing member having an annular portion of the side wall means deformed into the annular groove to secure the housing member to the adapter member the adapter member having an annular flange adjacent the section thereof, the open end of the cup-shaped housing member abutting against the annular flange, the section of the adapter member having a pair of annular shoulders on opposite sides of the annular groove thereof, the annular shoulder adjacent the annular flange having a larger diameter than the annular shoulder that is remote from the annular flange and being the part of the section that is press-fitted within the housing member.

It was also found according to the teachings of this invention that a burner construction can carry the flame sensing means thereof in a unique manner by disposing a portion thereof within the fuel receiving chamber of the cup-shaped housing member of the burner construction.

For example, another embodiment of this invention provides a burner construction comprising a cup-shaped housing member provided with a closed end having a substantially flat outer surface and an open end interconnected together by side wall means that has burner port means therethrough for issuing fuel from an interior chamber of the housing member, an adapter member secured to the housing member to close the open end thereof and having inlet means for directing fuel from a source thereof into the interior chamber of the housing member, and a flame sensing means having a portion disposed in the chamber of the cup-shaped housing member and having opposed ends one of which is secured to the closed end of the housing member and extends outwardly beyond said flat outer surface and the other of which is disposed outside the members.

Accordingly, it is an object of this invention to provide a new burner construction having one or more of the novel features of this invention as set forth above or hereinafter shown or described.

Another object of this invention is to provide a new method of making such a burner construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
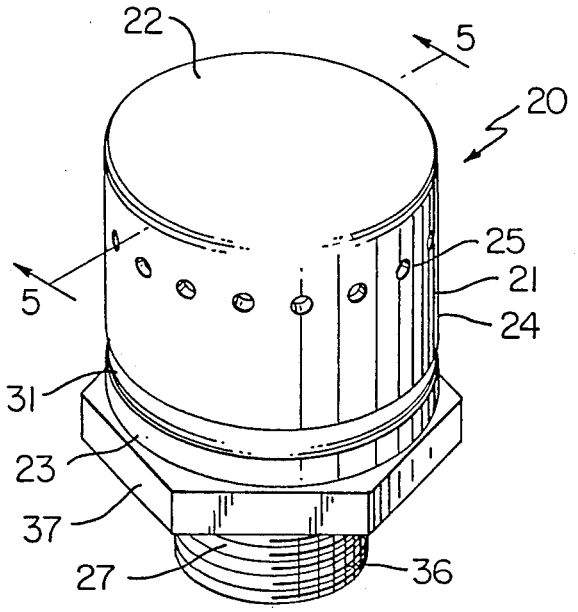
FIG. 1 is a top perspective view of one embodiment of the new burner construction of this invention.

While the various features of this invention are hereinafter illustrated and described as being particularly adapted to provide a dual rate burner construction for heating a water heater tank, it is to be understood that the various features of this invention can be utilized singly or in various combinations thereof to provide a burner construction for heating other devices as desired.

Therefore, this invention is not to be limited to only the embodiments illustrated in the drawings, because the drawings are merely utilized to illustrate one of the wide variety of uses of this invention.

Figure 5:
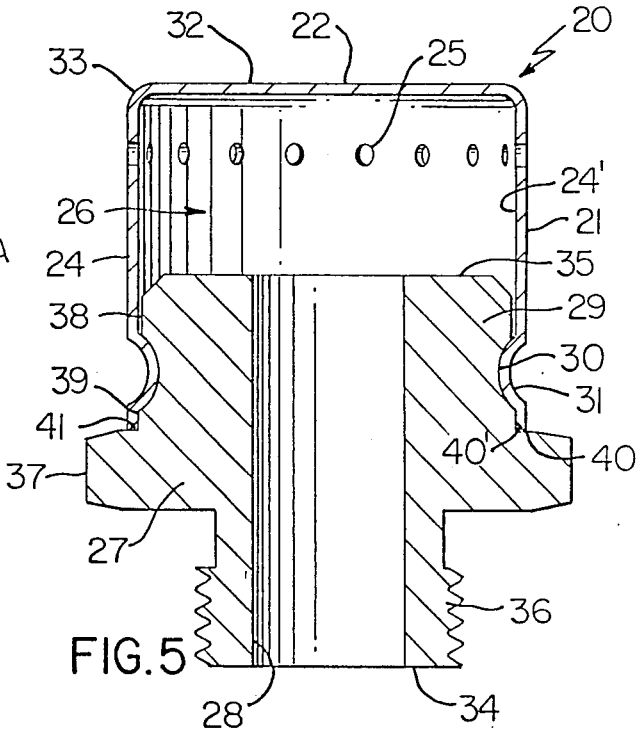
FIG. 5 is a cross-sectional view taken on line 5—5 of FIG. 1 and illustrates the completed burner construction from the parts of FIG. 2.

Referring now to FIG. 1, one embodiment of the improved burner construction of this invention is generally indicated by the reference numeral 20 and comprises a cup-shaped housing member 21 provided with a closed end 22 and an open end 23 interconnected together by side wall means 24 that has burner port means 25 therethrough for issuing fuel from the interior chamber 26 of the housing member 21, and an adapter member 27 secured to the housing member 21 to close the open end 23 thereof and having inlet means 28 for directing fuel from a source thereof (not shown) into the interior chamber 26 of the housing member 21, the adapter member 27 having a section 29 that is press-fittingly disposed within the open end 23 of the housing member 21 as illustrated in FIG. 5 and has an annular groove 30 adjacent the side wall means 24 thereof and the housing member 21 having an annular portion 31 of the side wall means 24 thereof deformed into the annular groove 30 to secure the housing member 21 to the adapter member 27 in a manner hereinafter set forth whereby no other means are required to hold the members 21 and 27 together to complete the burner construction 20 of this invention.

While the housing members 21 and 27 can be formed of any suitable material, the same have been formed of stainless steel and the member 21 has been formed by extruding so that the same has the closed end 22 thereof defining a substantially flat circular wall 32 that is integrally joined with the side wall means 24 by an annular arcuate portion 33 as illustrated, the side wall means 24 having a substantially circular transverse cross section throughout substantially the entire length thereof.

The burner ports 25 extend around the side wall means 24 in an aligned spaced apart relation and are disposed closely adjacent the closed end 22 of the housing member 21 as illustrated.

The adapter member 27 has the inlet 28 formed so a central opening passing through the opposed ends 34 and 35 thereof as illustrated.

The adapter member 27 has a lower section 36 that is externally threaded to permit a fuel supplying conduit (not shown) to be coupled to the adapter member 36 in a manner well known in the art.

An annular flange 37 is disposed intermediate the sections 29 and 36 of the adapter member 27 and can have a substantially hexagonal shape as illustrated in FIG. 1 to facilitate the aforementioned threading operation of the threaded section 36 thereof.

Figure 3:
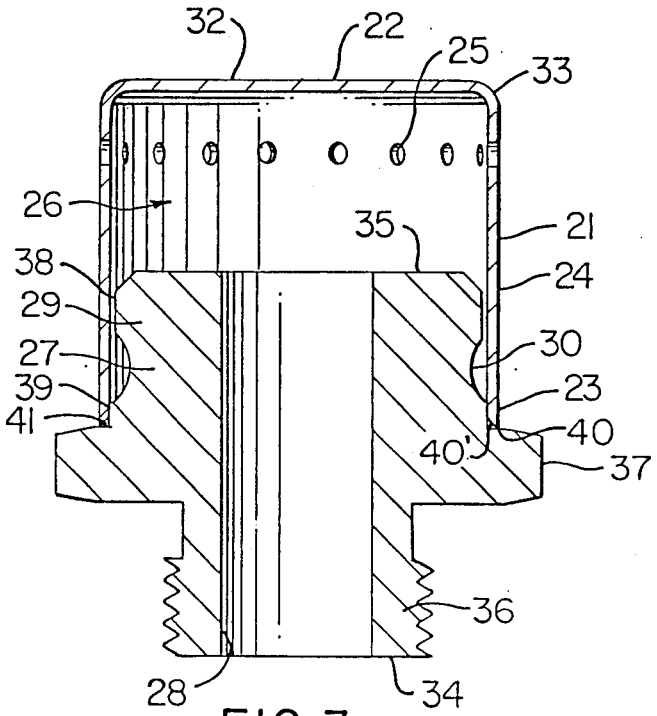
FIG. 3 is a view similar to FIG. 2 and illustrates the parts of FIG. 2 having been telescoped together in press-fitting relation.

The upper section 29 of the adapter member 27 defines a pair of annular shoulders 38 and 39 on opposite sides of the annular groove 30, the shoulder 39 having a diameter that is slightly larger than the diameter of the shoulder 38 and being of a diameter that fully permits the open end 23 of the housing member 21 to telescope over the same in the press-fit manner illustrated in FIG. 3 when the members 21 and 27 are initially disposed together, the open end 23 of the housing member 21 having a lower annular edge means 40 that is internally beveled at 40' to facilitate the press-fitting over the shoulder 39 and is adapted to abut against an annular shoulder 41 of the annular flange 37 as illustrated in FIG. 3 to limit the degree of insertion of the section 29 of the adapter 27 into the open end 23 of the housing member 21 during the making of the burner construction 20 of this invention.

Figure 4:
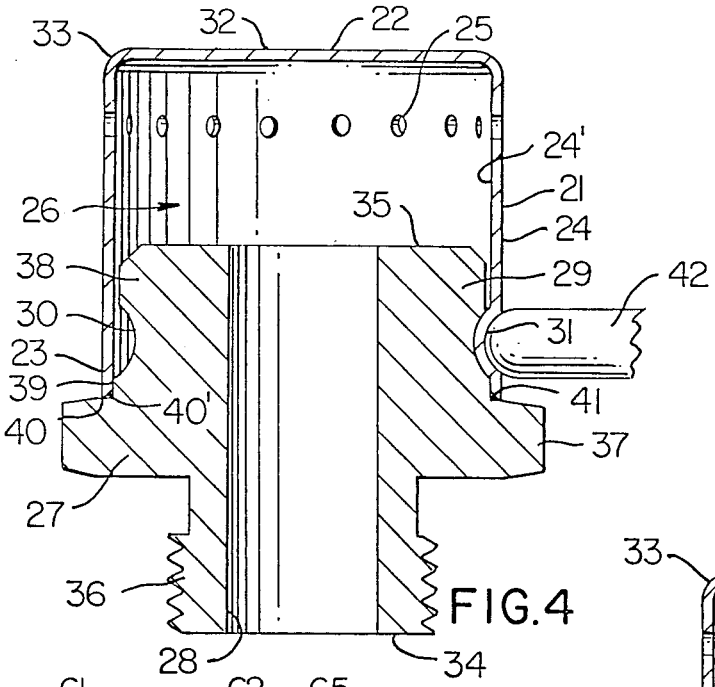
FIG. 4 is a view similar to FIG. 3 and illustrates the method of securing the two members of FIG. 2 together to form the burner construction of FIG. 1.

After the member 21 has been telescoped over the section 29 of the adapter member 27 in the press-fit manner illustrated in FIG. 3, the annular portion 31 of the side wall means 24 of the housing member 21 can be deformed into the annular groove 30 of the adapter member 27 in any suitable manner and it has been found that the same can be deformed by a rolling operation as illustrated in FIG. 4 wherein a rotatable roller means 42 is deforming the annular portion 31 of the side wall mans 24 of the housing member 21 fully within the groove 30 of the adapter member 27 to positively secure the housing member 21 to the adapter member 27 in the manner illustrated in FIG. 5 without requiring any additional securing means as it is found that the press-fit relation between the shoulder 39 of the section 29 of the adapter member 27 and the internal surface 24' of the side wall means 24 of the housing member 21 and the securement between the annular portion 31 of the housing member 21 and the annular groove 30 of the adapter member 27 by the aforementioned rolling operation is sufficient to prevent any adverse fuel leakage between the members 21 and 27 so that the flow of fuel into the inlet means 28 to the interior chamber 26 of the housing member 21 only flows out of the burner ports 25 to be ignited and burn with flame means external of the housing member 21 for any desired purpose.

Figure 6:
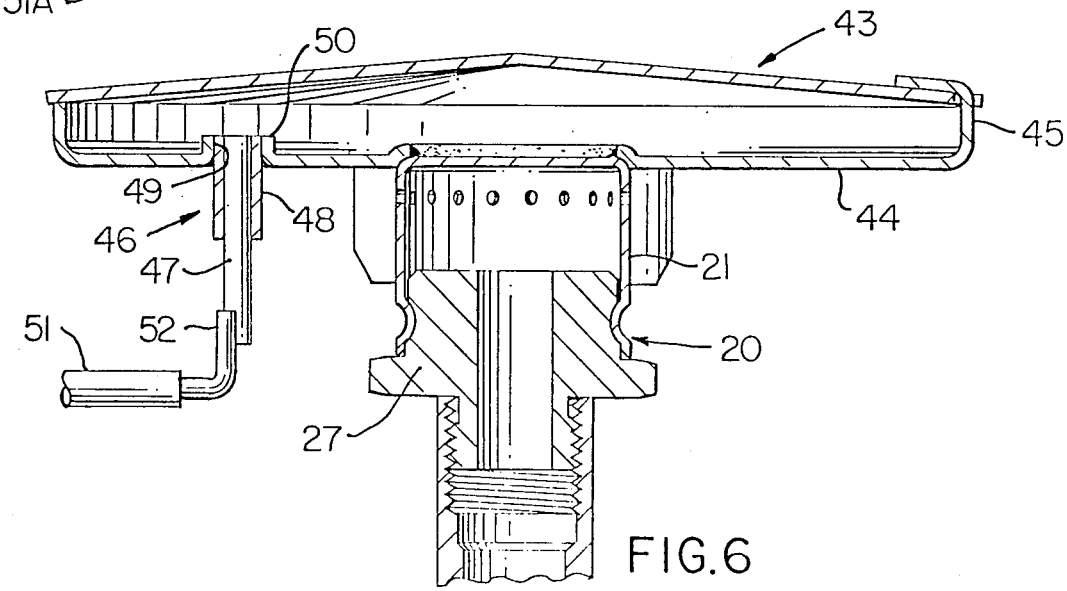
FIG. 6 is a fragmentary cross-sectional view illustrating the burner construction of FIG. 1 being utilized with a flame spreader means and a flame sensing means.

For example, the burner construction 20 can be utilized with a flame spreader means that is generally indicated by the reference numeral 43 in FIG. 6 which has a lower surface 44 against which the flames (not shown) that extend out of the burner ports 25 will be controlled so that when a full rate of flow of fuel is being directed to the burner construction 20, the flames will be directed by the wall means 44 out around the outer periphery 45 thereof for a heating purpose. For example, such arrangement as illustrated in FIG. 6 is fully disclosed and described as providing a dual rate burner construction for heating a water heater tank for a domestic home or the like in the copending patent application of J. R. Katchka et al, Ser. No. 769,572, filed Aug. 26, 1985, now U.S. Pat. No. 4,604,049, whereby this copending patent application is being incorporated into this disclosure by this reference thereto.

As disclosed in such aforementioned copending patent application, the flame spreader means 43 carries a flame sensing means that is generally indicated by the reference numeral 46 in FIG. 6 and comprises a thermocouple unit that has an inner rod 47 of Copel and an outer tubular member 48 of stainless steel being secured in an opening 49 of the flame spreader means 43, such as by being welded thereto. For example, the stainless steel tubular member 48 can be welded to the rod 47 and the stainless steel tube 48 can, in turn, be welded to the resulting tubular portion 50 of the flame spreader means 43 that defines the opening 49 thereof.

A suitable electrically insulated lead 51 has a bared end 52 electrically secured to the rod 47 by soldering, welding, brazing or the like so that the heat of the flame means of the burner construction 20 will cause the thermocouple unit 46 to generate an electrical current in a manner well known in the art to be directed by the lead means 51 to any suitable electrically or electromagnetically operated control valve means that supplies the fuel to the burner construction 20 in substantially the same manner as set forth in the aforementioned U.S. Pat. No. 3,998,582 to Katchka et al, whereby this patent is being incorporated into this disclosure by this reference thereto. Thus, a further discussion of the flame sensing means or thermocouple 46 and its use need not be provided as the same is fully disclosed in the aforementioned copending patent application and the aforementioned U.S. patent to Katchka et al.

Therefore, it can be seen that the burner construction 20 of this invention can be made from the housing member 21 and adapter member 27 in a simple and effective manner by the method of this invention as previously described to operate in a conventional manner whereby fuel is directed into the interior chamber 26 of the housing member 21 through the inlet means 28 of the adapter member 27 so that the fuel issuing out through the ports 25 can be ignited in any suitable manner and produce flame means which can be utilized for heating purposes, such as for heating a water heater tank as set forth in the aforementioned U.S. patent to Katchka et al.

Figure 2:
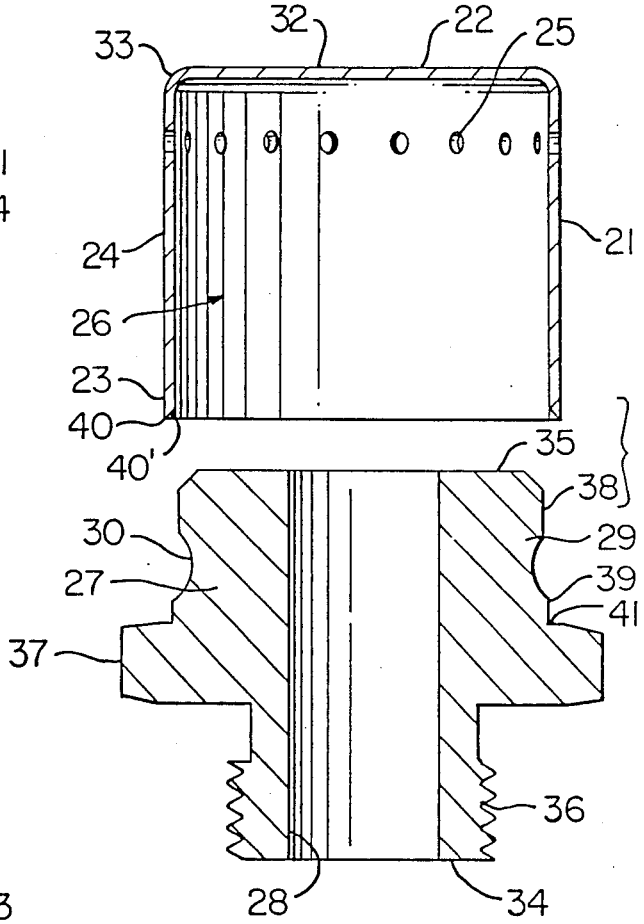
FIG. 2 is an exploded cross-sectional view of the two parts forming the burner construction of FIG. 1 in an initial unassembled condition thereof.

While the parts 21 and 27 of the burner construction 20 of this invention as previously described can have any suitable dimensions, one embodiment thereof that has been found satisfactory has the housing member 21, in its initial configuration as illustrated in FIG. 2, being formed of stainless steel of approximately 0.015 of an inch thick with the inside diameter of the side wall means 24 being approximately 0.618 of an inch, the length of the side wall means 24 between the closed end wall 32 and the end edge 40 thereof being approximately 0.550 of an inch, and the inside radius of the arcuate section 33 being approximately 1/32 of an inch. The burner ports 25 are disposed approximately 0.105 of an inch from the closed end wall 32, have a diameter of approximately 0.031 of an inch and are 20 in number so as to be approximately 18 degrees apart.

The adapter member 27 for the aforementioned housing member 21, has a length of approximately 0.625 of an inch between the surfaces 34 and 35 thereof, has the opening 28 of approximately 0.250 of an inch in diameter, has the shoulder 38 formed with a diameter of approximately 0.610 of an inch, has the shoulder 39 formed with a diameter of approximately 0.620 of an inch (thus providing a press-fit relation in the open end 23 of the housing member 21), and has the section 29 of a length of approximately 0.250 of an inch from the surface 35 to the shoulder 41 on the annular flange 37.

Of course, it is to be understood that the above dimensions are merely for illustrative purposes and are not to be a limitation on this invention.

Figure 7:
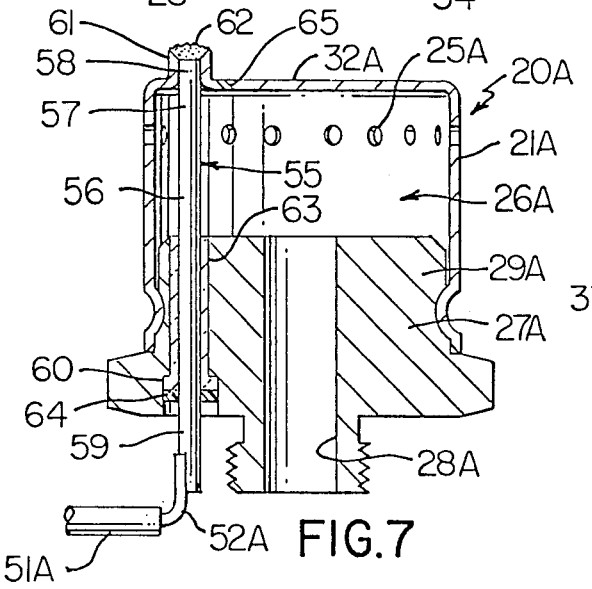
FIG. 7 is a view similar to FIG. 6 and illustrates another embodiment of the burner construction of this invention.

Another burner construction of this invention is generally indicated by the reference numeral 20A in FIG. 7 and parts thereof similar to the burner construction 20 previously described are indicated by like reference numerals followed by the reference letter "A".

As illustrated in FIG. 7, the burner construction 20A of this invention has the cup-shaped housing member 21A secured to the adapter member 27A in the same manner as the burner construction 20 previously described although it is to be understood that the housing member 21A could be secured to the adapter member 27A in any other desired manner, such as by being welded thereto as set forth in the aforementioned copending patent application.

In any event, the burner construction 20A includes a flame sensing means that is generally indicated by the reference numeral 55 and comprises a rod 56 of Copel that has a portion 57 disposed within the interior chamber 26A of the housing member 21A and is provided with opposed ends 58 and 59. One end 58 of the rod 56 is secured to the closed end 32A of the housing member 21A and the other end 59 of the rod 56 is disposed outside the members 21A and 27A by passing through an opening means 60 formed through the section 29A of the adapter member 27A so that the bared end 52A of the insulated lead 51A can be electrically secured thereto by soldering, welding, brazing or the like.

The end 58 of the flame sensing rod 56 is disposed within a tubular portion 61 formed from the closed end 32A of the housing member 21A and is secured thereto by a welding operation that produces the weld means 62 that closes the tubular portion 61 and secures the end 58 of the tubular portion 61 as illustrated.

A tubular member 63 of any suitable insulating material, such as a ceramic material, is telescoped on the rod 56 and insulates the rod 56 from the adapter member 27A as the tubular member 63 is disposed in the opening 60 and may be sealed therein by suitable sealing means 64 so as to prevent any gaseous fuel in the interior chamber 26A from escaping out of the opening 60.

Therefore, it can be seen that the burner construction 20A of this invention can be formed of the parts illustrated in FIG. 7 by the method of this invention to operate in a manner now to be described.

When fuel has been directed into the inlet means 28A of the adapter member 27A of the burner construction 20A to issue out of the burner ports 25A thereof and been ignited so as to form flames, the flow of fuel may be such that the flames sufficiently envelope the tubular portion 61 of the housing member 21A in a manner that the heat thereof generates an electrical current through the lead means 51A in a manner well known in the art whereby it may be found that no auxiliary port is required to have fuel directly burn and impinge against the upper end of the flame sensing means 55. However, should it be found that the flow of fuel out of the burner means 25a causes the flame means to be disposed away from the tubular portion 61 of the housing member 21A so that the same is not sufficiently heated, an auxiliary port 65 can be formed through the closed end wall 32A and be angled toward the tubular portion 61 as illustrated in FIG. 7 so that the fuel issuing out of the same will directly burn and impinge on the tubular portion 61 to sufficiently heat the same so that the flame sensing means 55 will generate a sufficient electrical current to indicate that the burner construction 20A is operating with flame means extending out of the burner ports 25A thereof.

In this manner, it can be seen that the burner construction 20A of this invention is adapted to have the flame sensing means 55 be provided with a portion 57 thereof disposed within the interior chamber 26A of the housing member 21A and still provide the flame sensing function in a manner similar to the flame sensing means 46 previously described which is disposed external to the burner construction 20.

Therefore, it can be seen that this invention not only provides new burner constructions, but also this invention provides new methods of making such burner constructions.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a burner construction comprising a cup-shaped housing member provided with a closed end and an open end interconnected together by side wall means that has burner port means therethrough for issuing fuel from the interior of said housing member, and an adapter member secured to said housing member to close said open end thereof and having inlet means for directing fuel from a source thereof into the interior of said housing member, the improvement wherein said adapter member has a section that is press-fittingly disposed within said open end of said housing member and has an annular groove adjacent said side wall means thereof, said housing member having an annular portion of said side wall means deformed into said annular groove to secure said housing member to said adapter member, said adapter member having an annular flange adjacent said section thereof, said open end of said cup-shaped housing member abutting against said annular flange, said section of said adapter member having a pair of annular shoulders on opposite sides of said annular groove thereof, the annular shoulder adjacent said annular flange having a larger diameter than the annular shoulder that is remote from said annular flange and being the part of said section that is press-fitted within said housing member.

2. A burner construction as set forth in claim 1 wherein said cup-shaped housing member is a one-piece extruded metallic member.

3. A burner construction as set forth in claim 1 wherein said closed end of said cup-shaped housing member is substantially flat and said side wall means of said cupshaped housing member is substantially circular in cross section.

4. A burner construction as set forth in claim 1 wherein said cup-shaped housing member has an internally beveled annular edge at said open end thereof to facilitate the press-fitting of said part of said section of said adapter member within said housing member.

5. In a method of making a burner construction comprising the steps of forming a cup-shaped housing member with a closed end and an open end interconnected together by side wall means that has burner port means therethrough for issuing fuel from the interior of said housing member, forming an adapter member, and securing said adapter member to said housing member to close said open end thereof and have an inlet means thereof for directing fuel from a source thereof into the interior of said housing member, the improvement comprising the steps of forming said adapter member to have a section that is press-fittingly disposed within said open end of said housing member and have an annular groove adjacent said side wall means thereof, forming said adapter member to have an annular flange adjacent said section thereof, forming said section of said adapter member to have a pair of annular shoulders on opposite sides of said annular groove thereof, forming the annular shoulder adjacent said annular flange to have a larger diameter than the annular shoulder that is remote from said annular flange and be the part of said section that is press-fitted within said housing member, abutting said open end of said cup-shaped housing member against said annular flange, and deforming an annular portion of said side wall means of said housing member into said annular groove to secure said housing member to said adapter member.

6. A method of making a burner construction as set forth in claim 5 and including the step of forming said cup-shaped housing member to be a one-piece extruded metallic member.

7. A method of making a burner construction as set forth in claim 5 and including the step of forming said closed end of said cup-shaped housing member to be substantially flat and said side wall means of said cup-shaped housing member to be substantially circular in cross section.

8. A method of making a burner construction as set forth in claim 5 and including the step of forming said cup-shaped housing member to have an internally beveled annular edge at said open end thereof to facilitate the step of press-fitting said part of said section of said adapter member within said housing member.

* * * * *